US006234934B1

(12) United States Patent
Gorczyca

(10) Patent No.: US 6,234,934 B1
(45) Date of Patent: May 22, 2001

(54) WRIST AND FOREARM EXERCISER

(76) Inventor: Joseph J. Gorczyca, 12683 22nd Avenue, Surrey British Columbia (CA), V4A 2B9

( * ) Notice: Subject to any disclaimer, the term of this patent is extended or adjusted under 35 U.S.C. 154(b) by 0 days.

(21) Appl. No.: 09/349,810

(22) Filed: Jul. 8, 1999

(51) Int. Cl.[7] ..... A63B 23/16

(52) U.S. Cl. ..... 482/50; 482/85; 482/87; 482/94; 482/108; 482/120

(58) Field of Search ..... 482/50, 120, 97, 482/106, 108, 83, 85, 87, 93, 94, 98; 446/207

(56) References Cited

U.S. PATENT DOCUMENTS

D. 264,237 * 5/1982 McCaleb et al. ..... 482/46
2,475,656 * 7/1949 Bidak ..... 482/46
3,901,503 * 8/1975 Klose ..... 272/57
4,438,920 * 3/1984 Veillette ..... 272/67
4,645,203 * 2/1987 Moss ..... 272/117

* cited by examiner

*Primary Examiner*—Jerome W. Donnelly
*Assistant Examiner*—Lori Baker Amerson

(57) ABSTRACT

A wrist and forearm exerciser for exercising the weak areas of the hands, arms, wrists, and forearms. The wrist and forearm exerciser includes an elongate handle rod and a line with opposite upper and lower ends. The upper end of the line is coupled to the handle rod. A weight support means is coupled to the lower end of the line. A plurality of weights are supported by the weight support means.

9 Claims, 3 Drawing Sheets

WRIST AND FOREARM EXERCISER

BACKGROUND OF THE INVENTION

1. Field of the Invention

The present invention relates to exercise equipment and more particularly pertains to a new wrist and forearm exerciser for exercising the weak areas of the hands, arms, wrists, and forearms.

2. Description of the Prior Art

The use of exercise equipment is known in the prior art. More specifically, exercise equipment heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,982,755; U.S. Pat. No. 5,060,933; U.S. Pat. No. 2,475,656; U.S. Pat No. 5,380,261; U.S. Pat. No. 5,547,441; and U.S. Pat. No. Des. 301,269.

While these devices fulfill their respective, particular objectives and requirements, the aforementioned patents do not disclose a new wrist and forearm exerciser. The inventive device includes an elongate handle rod and a line with opposite upper and lower ends. The upper end of the line is coupled to the handle rod. A weight support means is coupled to the lower end of the line. A plurality of weights are supported by the weight support means.

In these respects, the wrist and forearm exerciser according to the present invention substantially departs from the conventional concepts and designs of the prior art, and in so doing provides an apparatus primarily developed for the purpose of exercising the weak areas of the hands, arms, wrists, and forearms.

SUMMARY OF THE INVENTION

In view of the foregoing disadvantages inherent in the known types of exercise equipment now present in the prior art, the present invention provides a new wrist and forearm exerciser construction wherein the same can be utilized for exercising the weak areas of the hands, arms, wrists, and forearms.

The general purpose of the present invention, which will be described subsequently in greater detail, is to provide a new wrist and forearm exerciser apparatus and method which has many of the advantages of the exercise equipment mentioned heretofore and many novel features that result in a new wrist and forearm exerciser which is not anticipated, rendered obvious, suggested, or even implied by any of the prior art exercise equipment, either alone or in any combination thereof.

To attain this, the present invention generally comprises an elongate handle rod and a line with opposite upper and lower ends. The upper end of the line is coupled to the handle rod. A weight support means is coupled to the lower end of the line. A plurality of weights are supported by the weight support means.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wrist and forearm exerciser apparatus and method which has many of the advantages of the exercise equipment mentioned heretofore and many novel features that result in a new wrist and forearm exerciser which is not anticipated, rendered obvious, suggested, or even implied by any of the prior art exercise equipment, either alone or in any combination thereof.

It is another object of the present invention to provide a new wrist and forearm exerciser which may be easily and efficiently manufactured and marketed.

It is a further object of the present invention to provide a new wrist and forearm exerciser which is of a durable and reliable construction.

An even further object of the present invention is to provide a new wrist and forearm exerciser which is susceptible of a low cost of manufacture with regard to both materials and labor, and which accordingly is then susceptible of low prices of sale to the consuming public, thereby making such wrist and forearm exerciser economically available to the buying public.

Still yet another object of the present invention is to provide a new wrist and forearm exerciser which provides in the apparatuses and methods of the prior art some of the advantages thereof, while simultaneously overcoming some of the disadvantages normally associated therewith.

Still another object of the present invention is to provide a new wrist and forearm exerciser for exercising the weak areas of the hands, arms, wrists, and forearms.

Yet another object of the present invention is to provide a new wrist and forearm exerciser which includes an elongate handle rod and a line with opposite upper and lower ends. The upper end of the line is coupled to the handle rod. A weight support means is coupled to the lower end of the line. A plurality of weights are supported by the weight support means.

Still yet another object of the present invention is to provide a new wrist and forearm exerciser that helps an athlete develop strength, dexterity, and quickness in the hands, wrists, and arms.

Even still another object of the present invention is to provide a new wrist and forearm exerciser that functions as a rehabilitation device as well as an exerciser.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
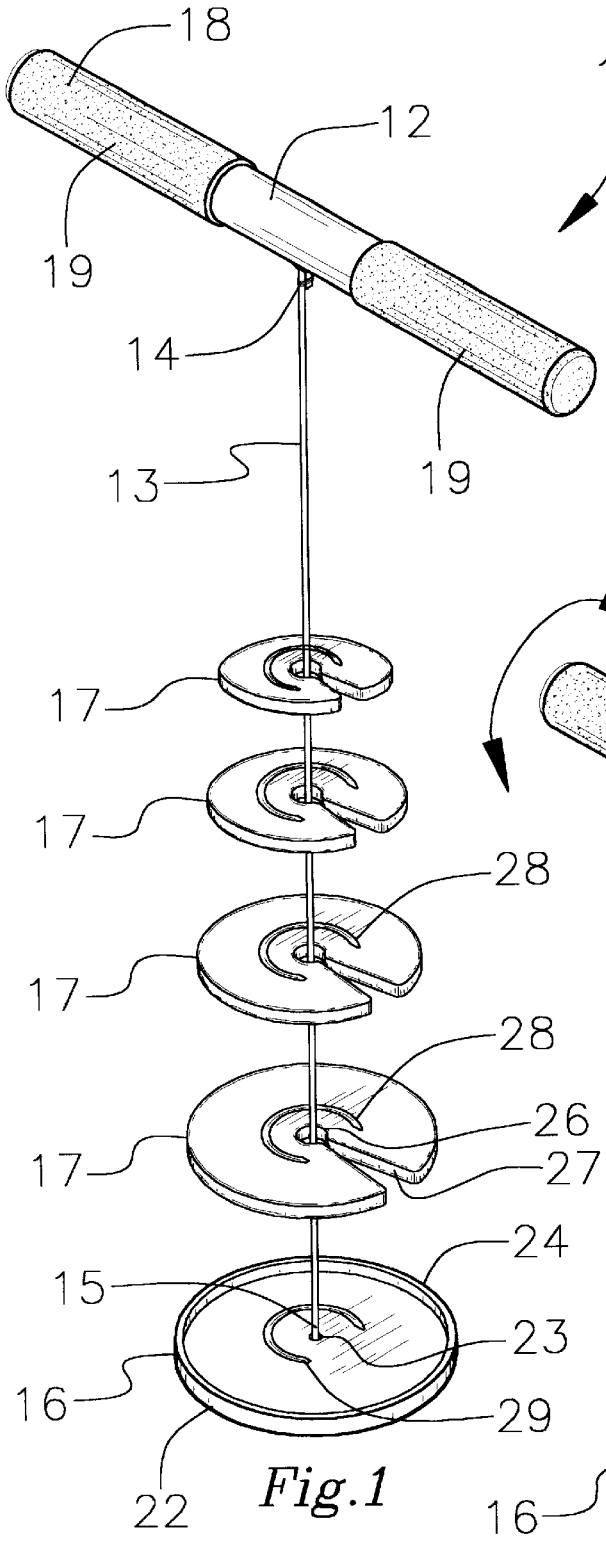
FIG. 1 is a schematic perspective view of a new wrist and forearm exerciser according to the present invention.
Figure 2:
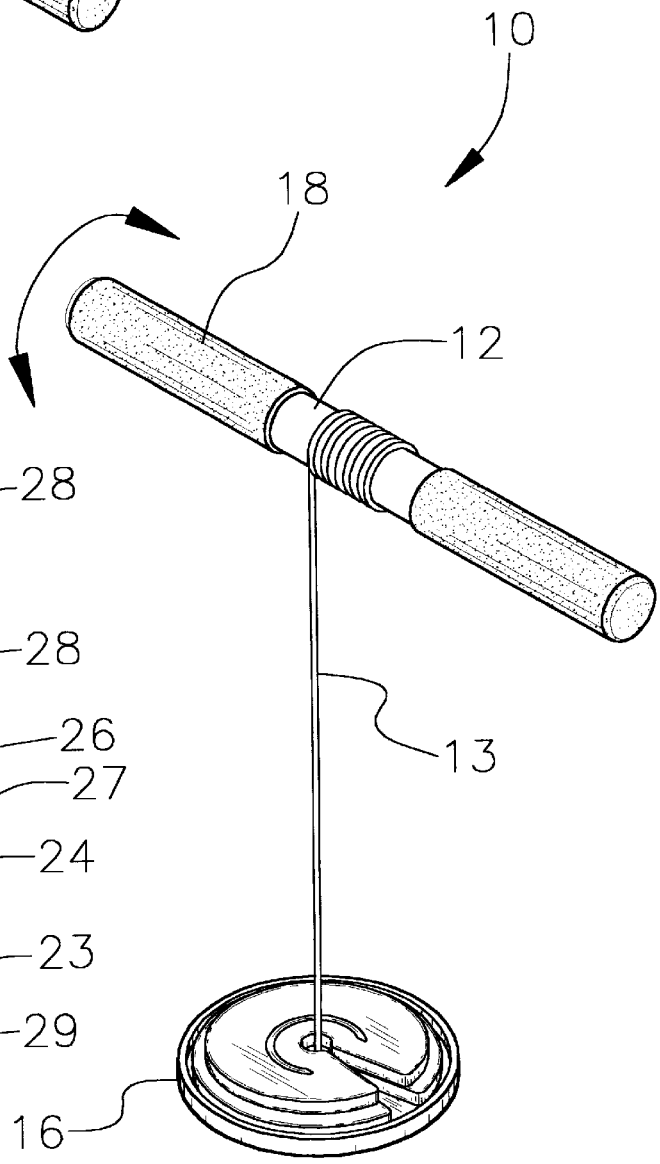
FIG. 2 is a schematic perspective view of the present invention.
Figure 3:
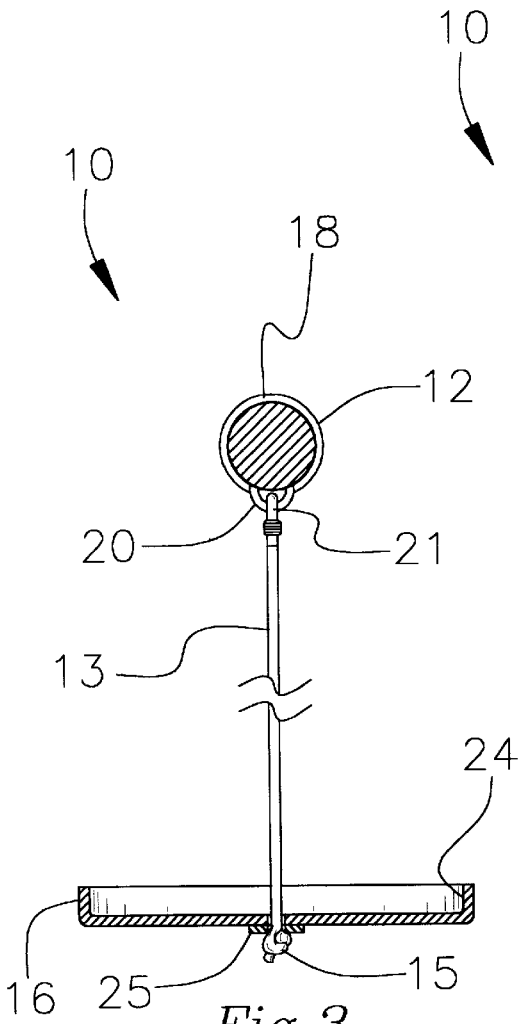
FIG. 3 is a schematic cross sectional view of the present invention.
Figure 4:
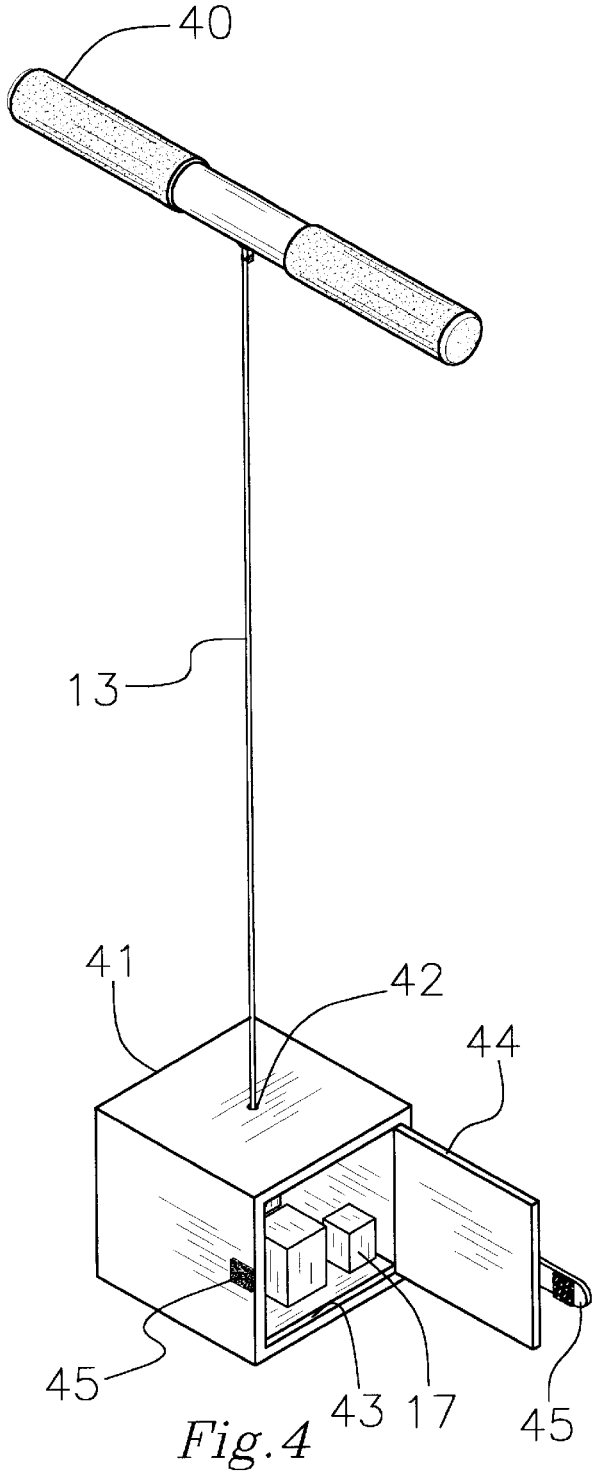
FIG. 4 is a schematic perspective view of a first alternate embodiment of the present invention.
Figure 5:
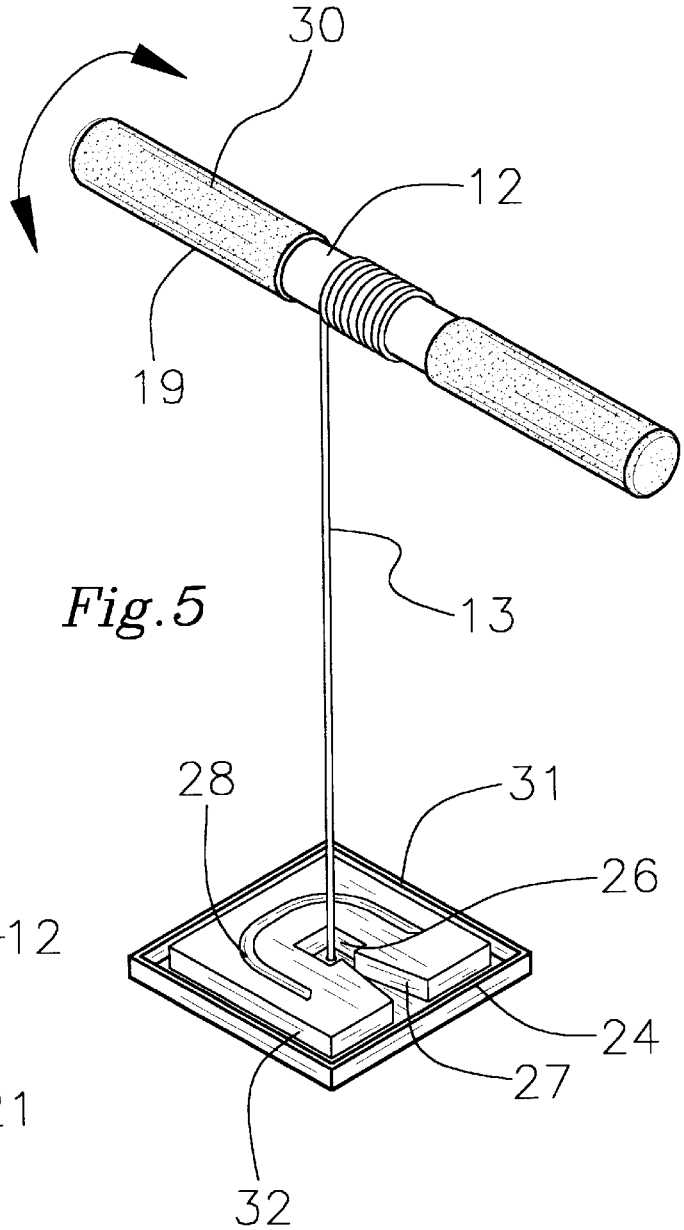
FIG. 5 is a schematic perspective view of a second alternate embodiment of the present invention.
Figure 6:
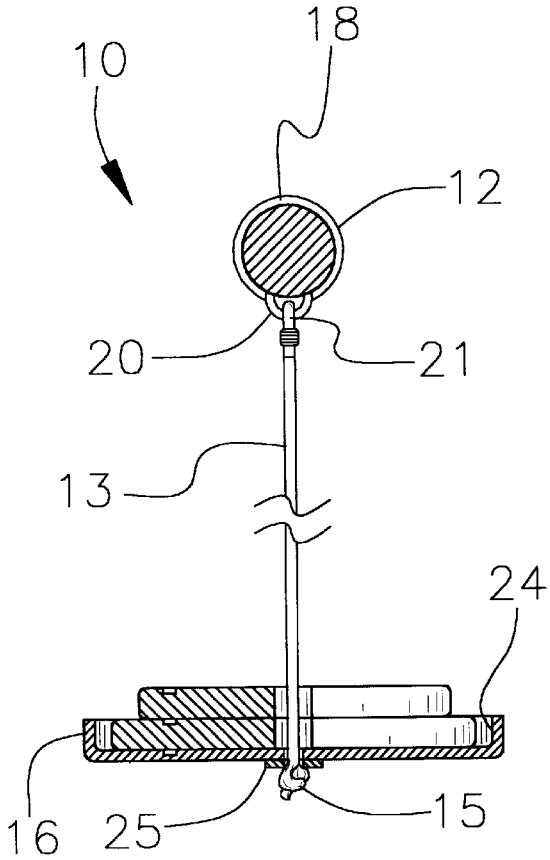
FIG. 6 is a schematic cross sectional view of the present invention.

With reference now to the drawings, and in particular to FIGS. 1 through 5 thereof, a new wrist and forearm exerciser embodying the principles and concepts of the present invention and generally designated by the reference numeral 10 will be described.

As best illustrated in FIGS. 1 through 5, the wrist and forearm exerciser 10 generally comprises an elongate handle rod 12 and a line 13 with opposite upper and lower ends 14,15. The upper end of the line is coupled to the handle rod. A weight support means 16 is coupled to the lower end of the line. A plurality of weights 17 are supported by the weight support means.

In more detail, the inventive device may take three forms. A first exercise device 18 comprises an elongate handle rod with a generally circular transverse cross section taken perpendicular to a longitudinal axis of the handle rod.

Preferably, the handle rod has a pair of grasping sleeves 19 extending inwardly from opposite ends of the handle rod. The grasping sleeves are adapted for being grasped by hands of a user. Ideally, the grasping sleeves comprise a resiliently deformable material such as rubber for frictionally enhancing contact between the hands and the handle rod.

Also preferably, the handle rod has a hook 20 detachably coupled to it towards a central portion of the handle rod. This permits removing of the line (discussed below) to replace it or to put on a line of a different length. This also permits the handle rod to be used with the other two embodiments (discussed below).

The line has opposite upper and lower ends. The upper end of the line has a loop 21. The hook of the handle rod extends through the loop for detachably coupling the line to the handle rod.

A generally circular tray 22 with a central aperture 23 through is coupled to the line. The lower end of the line extends through the central aperture and is tied in a knot.

Preferably, the tray has a peripheral lip 24 upwardly extending from an outer periphery thereof for holding the lower weight on the tray. A washer 25 may be positioned between the knot of the line and the tray.

A plurality of generally circular weights are positionable on the tray in a stacked orientation. Preferably, each of the weights has a middle aperture 26 and channel an insertion 27 extending from the middle aperture to an outer periphery of the weight for receiving the line therein. Ideally, the channel of each of the weights tapers together from the outer periphery of the weight towards the middle aperture. This permits easier insertion of the line while making it harder to remove so that the weight is less likely to fall off. This way, the line keeps the weight stack aligned.

Also ideally, each of the weights has an alignment channel 28 extending into a first surface thereof and a ridge 69 extending outwardly from a second surface thereof. The ridges of each of the weights are insertable in the channel of another of the weights. In such an embodiment, the tray would ideally have a channel 29 extending into an upper surface thereof that is adapted for receiving the ridges of the weights.

A second exercise device 30 comprises an elongate handle rod with a generally circular transverse cross section taken perpendicular to a longitudinal axis of the handle rod.

Preferably, the handle rod has a pair of grasping sleeves extending inwardly from opposite ends of the handle rod. The grasping sleeves are adapted for being grasped by hands of a user. Ideally, the grasping sleeves comprise a resiliently deformable material such as rubber for frictionally enhancing contact between the hands and the handle rod.

Also preferably, the handle rod has a hook detachably coupled to it towards a central portion of the handle rod. This permits removing of the line to replace it or to put on a line of a different length. This also permits the handle rod to be used with the other two embodiments.

The line has opposite upper and lower ends. The upper end of the line has a loop. The hook of the handle rod extends through the loop for detachably coupling the line to the handle rod.

A generally rectangular tray 31 with a central aperture through it is coupled to the line. The lower end of the line extends through the central aperture and is tied in a knot.

Preferably, the tray has a peripheral lip upwardly extending from an outer periphery thereof for holding the lower weight on the tray. A washer may be positioned between the knot of the line and the tray.

A plurality of generally rectangular weights 32 are positionable on the tray in a stacked orientation. Preferably, each of the weights has a middle aperture and a channel extending from the middle aperture to an outer periphery of the weight for receiving the line therein. Ideally, the channel of each of the weights tapers together from the outer periphery of the weight towards the middle aperture. This permits easier insertion of the line while making it harder to remove so that the weight is less likely to fall off. This way, the line keeps the weight stack aligned.

Also ideally, each of the weights has a channel extending into a first surface thereof and a ridge (not shown) extending outwardly from a second surface thereof, the ridges of each of the weights is insertable in the channel of another of the weights. In such an embodiment, the tray would ideally have a channel extending into an upper surface thereof that is adapted for receiving the ridges of the weights.

A third exercise device 40 comprises an elongate handle rod with a generally circular transverse cross section taken perpendicular to a longitudinal axis of the handle rod.

Preferably, the handle rod has a pair of grasping sleeves extending inwardly from opposite ends of the handle rod. The grasping sleeves are adapted for being grasped by hands of a user. Ideally, the grasping sleeves comprise a resiliently deformable material such as rubber for frictionally enhancing contact between the hands and the handle rod.

Also preferably, the handle rod has a hook detachably coupled to it towards a central portion of the handle rod. This permits removing of the line to replace it or to put on a line of a different length. This also permits the handle rod to be used with the other two embodiments.

The line has opposite upper and lower ends. The upper end of the line has a loop. The hook of the handle rod extends through the loop for detachably coupling the line to the handle rod.

A generally rectangular box 41 has a central aperture 42 through an upper panel thereof. The lower end of the line extends through the central aperture and is tied in a knot.

The box has an opening 43 into the box and a door 44 for closing the opening into the box. The door is pivotally coupled to the box and may have a hooks and loops closure 45.

The generally rectangular weights, used with the second embodiment, are positionable in the box.

The length of each handle between its ends should be between about 10 and 18 inches to comfortably accommodate the hands of the user while has a sufficient area between the grasping sleeves.

The preferred design for the tray of the first embodiment is circular with an outer diameter of approximately 4 to 5 inches.

The preferred design for the box is substantially square with dimensions of about 4 to 5 inches by about 4 to 5 inches by about 4 to 5 inches. The box design permits things other than the rectangular weights to be placed in the box. Stones, round weights, lead fishing weights, etc. may also be placed in the box and held there by the door.

The preferred outer diameter of the largest of the round weights is approximately 4 inches. The preferred embodiment of the rectangular weights is square with dimensions of about 4 inches by 4 inches.

The preferred length of the line is about 6 feet. This length would accommodate a user from 7 years of age through 80 years of age, regardless of height. The user simply wraps any excess line around the handle until the remainder is of the desired length.

Alternatively, three lengths of line could be provided with the unit: a short length line (about 5 feet long) for users under 5 feet tall, a medium length line (about 5.5 feet long) for those between 5 and 6 feet tall, and a long length line (about 6 feet long) for those over 6 feet tall.

In use, the desired embodiment is selected and weights are placed on the tray or in the box. Grasping the handle rod, the arms are extended straight out at about a 90 degree angle. The handle rod is rotated until the weights and tray or box reach a desired height. Then the rod is rotated in the opposite direction to lower the weights and box or tray back down towards the floor. This procedure is repeated for a predetermined number of times.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An exercise device for exercising hands, wrists, and forearms of a user, the device comprising:

an elongate handle rod;

a line having opposite upper and lower ends, said upper end of said line being coupled to said handle rod;

a weight support means being coupled to said lower end of said line;

a plurality of weights being supported by said weight support means;

wherein each of said weights has a middle aperture and an insertion channel extending from said middle aperture to an outer periphery of said weight for receiving said line therein;

wherein a width of said insertion channel of each of said weights taper smaller from said outer periphery of said weight towards said middle aperture for facilitating insertion of said line into said insertion channel and resisting removal of said line from said insertion channel.

2. The exercise device of claim 1, wherein said handle rod having a pair of grasping sleeves extending inwardly from opposite ends of said handle rod, said grasping sleeves being adapted for being grasped by hands of a user, wherein said grasping sleeves comprise a resiliently deformable material for frictionally enhancing contact between said hands and said handle rod.

3. The exercise device of claim 1, wherein said handle rod has a hook detachably coupled thereto towards a central portion of said handle rod, said hook of said handle rod detachably coupling said line to said handle rod.

4. The exercise device of claim 1, wherein said weight support means comprises a generally circular tray coupled to said lower end of said line, said weights being generally circular.

5. The exercise device of claim 5, wherein each of said weights has a channel extending into a first surface thereof and a ridge extending outwardly from a second surface thereof, said ridges of each of said weights being insertable in said channel of another of said weights.

6. The exercise device of claim 1, wherein said weight support means comprises a generally rectangular tray coupled to said lower end of said line, said weights being generally rectangular.

7. The exercise device of claim 1, wherein said weight support means comprises a generally rectangular box coupled to said lower end of said line, said weights being generally rectangular.

8. An exercise system for exercising hands, wrists, and forearms of a user, the system comprising:

a first exercise device, comprising:

an elongate handle rod having a generally circular transverse cross section taken perpendicular to a longitudinal axis of the handle rod;

said handle rod having a pair of grasping sleeves extending inwardly from opposite ends of said handle rod, said grasping sleeves being adapted for being grasped by hands of a user;

wherein said grasping sleeves comprise a resiliently deformable material for frictionally enhancing contact between said hands and said handle rod;

said handle rod having a hook detachably coupled thereto towards a central portion of said handle rod;

a line having opposite upper and lower ends, said upper end of said line having a loop, said hook of said handle rod extending through said loop for detachably coupling said line to said handle rod;

a generally circular tray having a central aperture therethrough, said lower end of said line extending through said central aperture;

said lower end of said line being tied in a knot;

said tray having a peripheral lip upwardly extending from an outer periphery thereof;

a washer being positioned between said knot of said line and said tray;

a plurality of generally circular weights being positionable on said tray in a stacked orientation;

each of said weights having a middle aperture and an insertion channel extending from said middle aperture to an outer periphery of said weight for receiving said line therein;

wherein said insertion channel of each of said weights tapers together from said outer periphery of said weight towards said middle aperture;

each of said weights having an alignment channel extending into a first surface thereof and a ridge extending outwardly from a second surface thereof, said ridges of each of said weights being insertable in said alignment channel of another of said weights; and said tray having an alignment channel extending into an upper surface thereof adapted for receiving said ridges of said weights.

9. An exercise system for exercising hands, wrists and forearms of a user, the system comprising:

an elongate handle rod having a generally circular transverse cross section taken perpendicular to a longitudinal axis of the handle rod;

said handle rod having a pair of grasping sleeves extending inwardly from opposite ends of said handle rod, said grasping sleeves being adapted for being grasped by hands of a user;

wherein said grasping sleeves comprise a resiliently deformable material for frictionally enhancing contact between said hands and said handle rod;

said handle rod having a hook detachably coupled thereto towards a central portion of said handle rod;

a line having opposite upper and lower ends, said upper end of said line having a loop, said hook of said handle rod extending through said loop for detachably coupling said line to said handle rod;

a generally rectangular box having a central aperture through an upper panel thereof, said lower end of said line extending through said central aperture;

said lower end of said line being tied in a knot;

said box having an opening into said box and a door for closing said opening into said box;

said generally rectangular weights being positionable in said box; and said door having a hooks and loops closure.

* * * * *